United States Patent [19]

Konishi et al.

[11] Patent Number: 4,823,097

[45] Date of Patent: Apr. 18, 1989

[54] MICROWAVE DIRECTIONAL COUPLER

[75] Inventors: Yoshihiro Konishi, Sagamihara; Haruaki Fujimoto, Yachiyo, both of Japan

[73] Assignee: Uniden corporation, Ichikawa, Japan

[21] Appl. No.: 54,505

[22] Filed: May 27, 1987

[30] Foreign Application Priority Data

Jul. 4, 1986 [JP] Japan ..... 61-156153

[51] Int. Cl.[4] ..... H01P 5/18

[52] U.S. Cl. ..... 333/116; 333/238

[58] Field of Search ..... 333/116

[56] References Cited

U.S. PATENT DOCUMENTS 4,150,345 4/1979 Goldman et al. ..... 333/116

4,482,873 11/1984 Nyhus ..... 333/116

FOREIGN PATENT DOCUMENTS 176054 4/1986 European Pat. Off. ..... 333/116

*Primary Examiner*—Paul Gensler

*Attorney, Agent, or Firm*—Oblon, Fisher, Spivak, McClelland & Maier

[57] ABSTRACT

A microwave directional coupler which has a second dielectric board which stands erect on the surface of the first dielectric board; coupling elements are arranged with their planes facing each other on both sides of the second dielectric board, forming a coupling line part; and both end parts of the coupling line part are formed on the first dielectric board so that they can be connected by lead lines.

4 Claims, 8 Drawing Sheets

MICROWAVE DIRECTIONAL COUPLER

BACKGROUND OF THE INVENTION

The present invention relates to a microwave directional coupler which is applicable to mixing, distribution and switching controls of microwave signals, and particularly to a distributed coupling type microwave directional coupler which has a pair of coupling line parts provided facing each other on both sides of a dielectric substance.

Circuit systems for processing microwave signals in most cases require directional couplers, for instance for mixing. As is well known, in these microwave regions, there are two methods for configuring directional couplers. Waveguides are used in one method, and strip lines or conductor lines are used in the other.

However, the latter type of directional couplers using conductor lines are believed to respond especially well to the latest needs for lightweight, compact electronic equipment, since they can be mounted on the same circuit board as the other circuit components.

Various types of such microwave directional couplers using conductor lines have been developed in the past, but those illustrated in FIGS. 1 through 7(B) may be regarded as typical. These couplers can be classified into two types: those of the continuous conductor pattern type, illustrated in FIGS. 1 and 2; and those of the quarter-wavelength distributed coupling type, illustrated in FIGS. 3 through 7(B).

The directional coupler 10 illustrated in FIG. 1 uses a plane type distribution line, in which all the conductor patterns are in ohmic contact at the D.C. level. It is generally called the "branch line" type. Described simply, the two pairs of terminals facing each other (pair 11 and 12 and pair 13 and 14) are each connected by single conductor lines 15 and 16, and the lines 15 and 16 are connected to each other at two places midway along their lengths, the interval separating them being equal to about a quarter wavelength. The connections are effected through two bridge lines (17 and 18) which face each other and which each have a length equal to about a quarter wavelength.

These conductor patterns are usually formed by patterning on a board (printed-wiring board) 19 made of a suitable dielectric material, and the desired circuitry is configured by mounting this directional coupler 10 on the same board as the other circuit systems, not shown in the figure.

In this directional coupler 10, signals inputted from the terminal 11 are outputted to the terminals 12 and 14, but not to the terminal 13. On the other hand, signals from the terminal 13 are outputted to the terminals 12 and 14, but not to the terminal 11.

The directional coupler 20 shown in FIG. 2 is called the "rat race" type. It is configured by patterning on a dielectric board 21 a circular conductor pattern 22 with a circumference equal to about 1½ wavelengths, terminals 23 and 24 drawn out from two places facing each other in the radial direction, and two terminals 25 and 26 drawn out from points located about a quarter wavelength to the left or to the right from the terminals 23 and 24. In this directional coupler 20, microwave signals inputted from the terminal 23 are outputted to the terminals 24 and 25, but not to the terminal 26, and microwave signals from the terminal 24 are outputted to the terminals 23 and 26, but not to the terminal 25.

The directional couplers 10 and 20, shown in FIGS. 1 and 2, as mentioned above, both are formed so that their terminals are connected to each other perfectly by means of conductors. There are other types of directional couplers, called the quarter-wavelength distributed coupling type, in which the couplings are effected through distributed capacity.

FIG. 3 illustrates the basic configuration of a directional coupler 30 of the quarter-wavelength distributed coupling type. It has a pair of coupling lines 31 and 32, each having a length approximately equal to a quarter wavelength. They are located in parallel to each other as separated by a gap 33. Therefore, since the coupling lines 31 and 32 have their narrow sides facing each other, this coupler is sometimes called the "narrow side coupling" type. The terminal lines 34, 35 and 36, 37 are drawn out from both ends of each of the coupling lines. These conductor patterns are also formed by patterning on the surface of a suitable dielectric board 38.

In this directional coupler 30, microwave signals inputted from the terminal 34 are outputted to the terminals 35 and 36, but not to the terminal 37; and microwave signals inputted from the terminal 36 are outputted only to the terminals 34 and 37, but not to the terminal 35.

The directional coupler 40 shown in FIG. 4 is of one called the "overlay" type. The degree of coupling is improved by a short-circuit plate 44 which overlays the coupling lines 41 and 42 (corresponding to the lines 31 and 32 in FIG. 3) on the sectional area along line IV—IV, and the gap 43 between them.

The coupling lines 41 and 42 are formed by patterning on a dielectric board 45 and are embedded between the boards 45 and 46. 47 denotes the reference potential conductor surface (usually connected to a ground). This reference potential conductor surface 47 does not need to extend over the entire bottom surface of the board 45; it is sufficient if it covers only the part of the bottom surface corresponding to the coupling parts of the aforesaid coupling lines. This reference potential conductor surface is, of course, adopted in component structures which include the conventional examples given above.

The conventional example shown in FIG. 5 is a directional coupler 50 of the so-called tandem-connection type. The conventional example shown in FIG. 6 is a directional coupler 60 of the so-called interdigital type.

In each of these examples, coupling parts (55 or 6) having a tandem or interdigital shape for giving a predetermined orientation to the couplings between the four signal input/output terminals (51, 52 and 53, 54, or 61, 62 and 63, 64) are formed on the surface of a dielectric board (56 or 66), and these coupling parts are connected through bridge lines (57 and 58 or 67 and 68) formed with specific conductor patterns.

There are also conventional examples with a three-dimensional structure, in which horizontal layers are laminated in the vertical direction. The Triplate type directional coupler 70 shown in FIG. 7(A) and FIG. 7(B) is an example of such a coupler.

This directional coupler 70 is configured with a pair of dielectric boards 78 and 79 facing each other and separated from each other by a dielectric spacer board 80 which maintains them in this state. The dielectric boards 78 and 79 have on one surface pattern consisting of pairs of terminal lines (71*a*, 71*b* and 72*a*, 72*b*) and coupling lines 73 and 74; and on the other surface they have grounding conductor surface patterns 75 and 76.

Generally, the aforesaid three-layer structure is contained in a housing 81, the interior of which is sealed by clamping both halves 81*a*, 81*b* together with screws 82, as is shown in FIG. 7(B). If this housing 81 is made of metal, the aforesaid grounding conductor surface patterns 75 and 76 on the rear surfaces of the dielectric boards 78 and 79 are not needed.

As described above, there have been in the past various types of microwave directional couplers using conductor lines. Each type has its own advantages and disadvantages, and they all are laden with problems which need to be solved with respect to their performance as well as their physical construction.

First of all, let us mention a drawback which is believed to be common to all past configurations. That is, the material of the dielectric boards, which are necessary in directional couplers of this type, imposes severe restrictions on attaining the desired performance, not only because of the electrical characteristics which are required in these directional couplers, but also because of various other factors. For example, in the actual circuit designs in the past examples given above, a portion of the printed circuit board accommodating other peripheral circuits is commonly used for the dielectric board. That is, the conductor line patterns needed in a directional coupler of this type are formed integrally at the same time that the conductor patterns for the other circuit elements are formed on the printed-wiring board.

As a result, it is impossible to use expensive materials such as Teflon for the boards for directional couplers. Teflon, although expensive, has little dielectric loss and is suitable as the material for boards for directional couplers. However, such an expensive material cannot be used because the other circuit element parts calls for a large wasteful space. Generally speaking, there is a powerful demand for adopting cheaper elements. Consequently, a compromise solution was adopted in the past, using at the best materials such as glass epoxy resin or paper phenol which offered a tradeoff between the performance and costs of printed-wiring boards.

In addition to this common drawback, the directional couplers of the past still had problems unique to each type.

The directional couplers 10 and 20 of the "branch line" and "rat race" types illustrated in FIGS. 1 and 2 both have a drawback which cannot be ignored. That is, they both must occupy large two-dimensional spaces.

Concretely speaking, if the directional couplers 10 and 20 are to be used, for example, in microwave mixer stages of 1 GHz band, they will require, on their short sides alone, a rectangular plane space of at least 3 to 4 cm or more. This generally amounts to a more or less square space of 9 to 16 $cm^2$ or even more.

This space is a quite large area. If we consider, for example, an application in which such microwave-using equipment is used in radar detectors or satellite communication receivers, we find that the circuit board area required by all the other circuits exclusive of these directional couplers will be on the order of 10 cm or less on their long sides. One can understand from this what a large area is occupied, comparatively, by the single circuit element of this mixer stage alone.

In this way, the size of the area occupied has recently become a bottleneck when electronic circuit systems using directional couplers of this type are put into practical application.

There still were drawbacks even when the conventional directional couplers of the types shown in FIGS. 1 and 2 were given −3 dB type designs. For example, the two outputs obtained by branching a single input tended to have differing intensities, and the bandwidths used were also narrow.

The bandwidths were improved in the quarter-wavelength type directional coupler 30 shown in FIG. 3, which had relatively broader bandwidths. However, there were other problems, such as a low degree of coupling and a limited degree of designing freedom.

In the "overlay" type directional coupler 40 shown in FIG. 4, the use of the short-circuit plate 44 not only broadened the bandwidths but also considerably improved the degree of coupling. Nevertheless, the embedded construction of the coupling lines 41 and 42 was impractical, being too difficult to fabricate.

With the tandem connection type directional coupler 50 shown in FIG. 5 and the interdigital type directional coupler 60 shown in FIG. 6, it was possible to improve the characteristics considerably. However, they also were impractical and difficult to fabricate because they required bridge lines (57 and 58, 67 and 68) spanning over the tops of the boards.

As for the Triplate type illustrated in FIG. 7(A) and FIG. 7(B), one would expect, in general principle, that extremely satisfactory results ought to be obtained. However, it is difficult to maintain the structure needed in order to obtain a good performance, and extremely advance technologies are required in order to position precisely all three layers. In addition, problems are presented by variations caused by the degree of tightening of the screws 82 when assembling the housing 81, and also by warping caused by the gaps between the boards 78, 79 at the parts where conductor patterns 73, 74 of the coupling lines are not present and the dielectric spacer board 80 between them.

Moreover, another drawback comes from the fact that the input/output terminals are located in the vacant spaces at the top, separated from the boards by intervals in the vertical direction. Therefore, there are difficulties in connecting them with the wiring parts of other peripheral circuit systems on the circuit board.

SUMMARY OF THE INVENTION

This invention was made in consideration of the aforesaid drawbacks of the microwave directional couplers of the past. Its object is to provide a microwave directional coupler in which the two-dimensional plane area occupied can be reduced, which is easy to fabricate, and in which the electrical characteristics can be improved.

To attain the above object, the microwave directional coupler of this invention comprises a first dielectric board, a second dielectric board erected on the chief surface of the first dielectric board, a coupling line part having at least one pair of coupling elements formed on both surfaces of the second dielectric board, and lead lines which are connected to the coupling line elements and which are formed on the first dielectric board.

The major parts playing a role in coupling in microwave directional couplers i.e., both coupling elements in the coupling line part, are formed on the sides of the second dielectric board, which stands up independently of the first dielectric board.

Consequently, the area occupied by the coupler on the first dielectric board can be reduced. Moreover, since the structure is simple, the coupler can be fabricated easily without requiring any far-reaching changes in the existing printed-wiring technology.

Additional objects and characteristics will be clear from the detailed description below based on the attached drawings.

DETAILED DESCRIPTION OF THE PREFERRED EMBODIMENT

A first embodiment incorporating the basic configurations of the microwave directional coupler of this invention is illustrated in FIG. 8(A)-(D).

The coupler 100 of this invention consists of a first dielectric board 101 and a second dielectric board 102. The second dielectric board 102 is erected perpendicularly to the first dielectric board 101, and both surfaces 102*a*, 102*b* of the second dielectric board 102 are vertical with respect to the surface of the first dielectric board 101.

Figure 1:
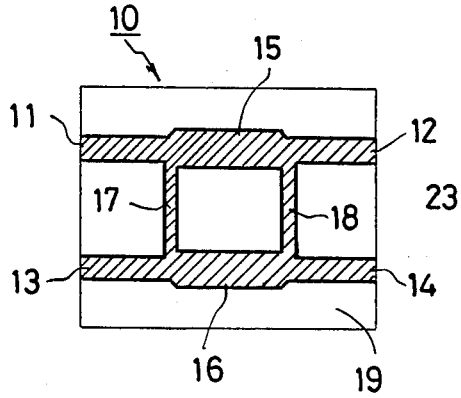
FIG. 1 PRIOR ART
FIGS. 1 through 7(B) are schematic drawings of the configurations of various directional couplers of the past.
Figure 2:
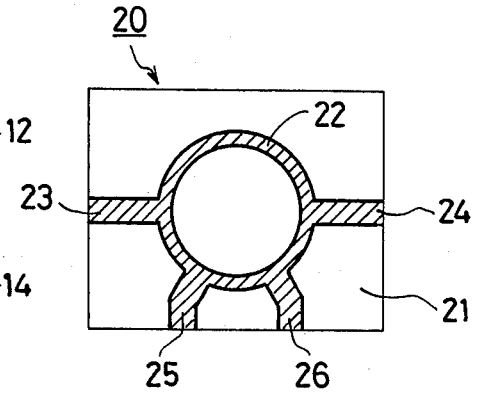
FIG. 2 PRIOR ART
Figure 3:
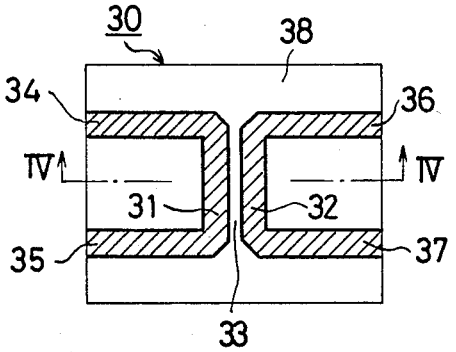
FIG. 3 PRIOR ART
Figure 4:
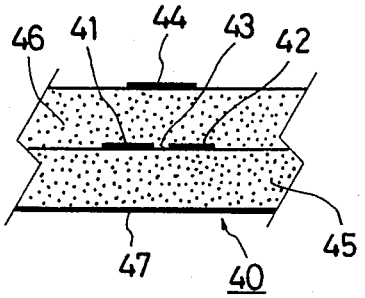
FIG. 4 PRIOR ART
Figure 5:
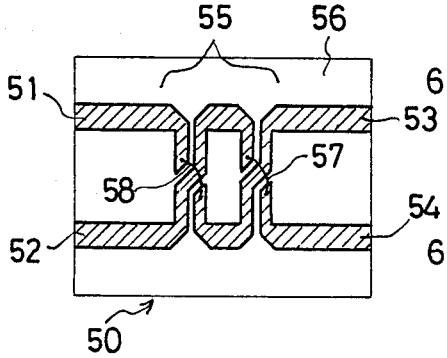
FIG. 5 PRIOR ART
Figure 6:
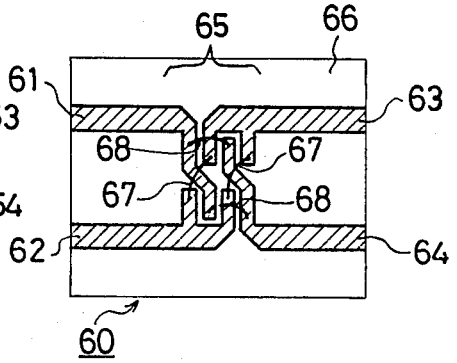
FIG. 6 PRIOR ART
Figure 7A:
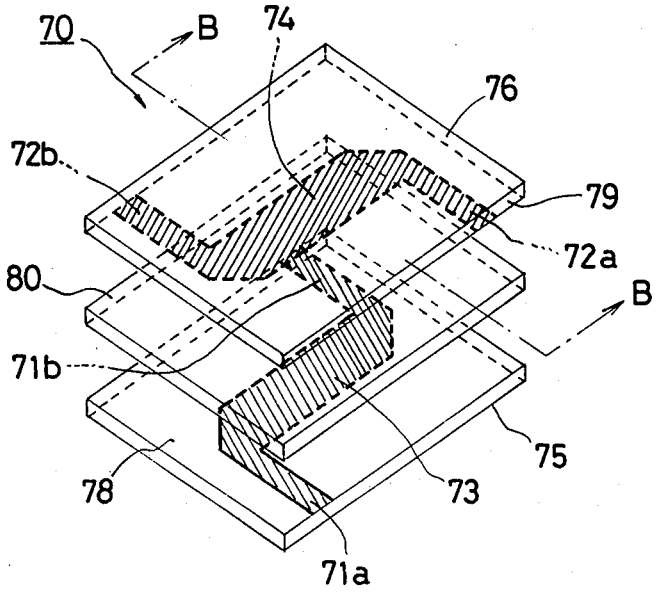
FIG. 7(A) PRIOR ART
Figure 7B:
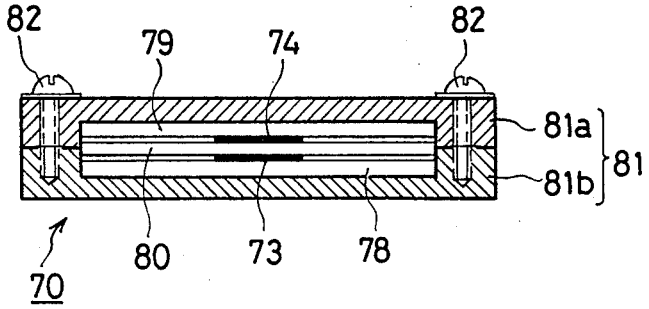
FIG. 7(B) PRIOR ART
Figure 8A:
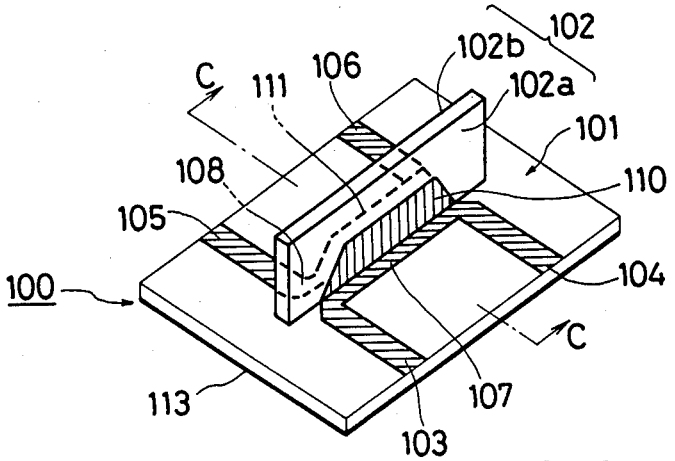
FIGS. 8(A)-(D) are schematic drawings of the configuration of an embodiment of the microwave directional coupler of this invention.
Figure 8B:
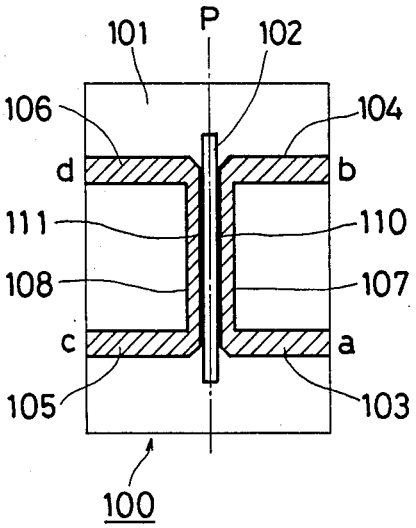

Consequently, in this embodiment, both surfaces 102*a*, 102*b* of the second dielectric board 102 have a plane-symmetrical relationship to the imaginary plane P passing through the center of thickness of the second dielectric board, as is shown in particular in FIG. 8(B) and (C).

Lead lines (103, 104 and 105, 106) comprising the four signal input/output terminals are patterned on the first dielectric board 101, and distribution line parts 107, 108 for adjusting the characteristics of this directional coupler are also formed by patterning.

On the other hand, coupling line elements constituting a coupling line part 110, 111 are formed on the aforesaid surfaces 102*a*, 102*b* of the second dielectric board 102.

In the embodiment illustrated in the drawings, the coupling line elements 110, 111 are formed by patterning as patterns 110, 111 having a predetermined conductor shape and conductor width. However, in actual applications, they might consist of a number of partial coupling elements, or their configurations might include electrical connections penetrating through the second dielectric board if necessary.

The simplest way of realizing these conductor lines or coupling elements 110, 111 generally would be to form them by the same method as that use in patterning the wiring on ordinary printed-wiring boards. This method has a good dimensional precision and a high reliability. However, they may also, of course, be formed by attaching conductor foil individually.

Figure 8C:
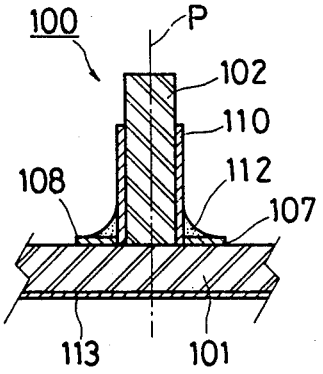

In this embodiment, the corresponding lead lines 103-106 are connected and fastened to the coupling elements 110, 111, and the coupling elements 110, 111 are in turn connected and fastened to the distribution line parts 107, 108. These connections may be made by means of solder 112, as shown in FIGS. 8(C), or by using some suitable conductive adhesive.

Figure 8D:
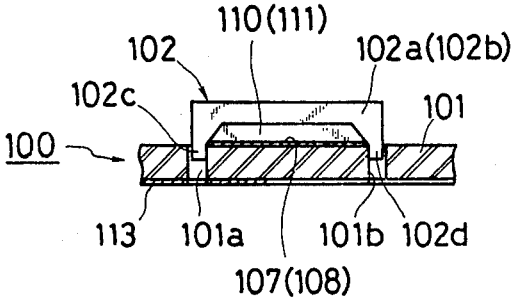

It is not invariably necessary to use some means of physically fastening the second dielectric board 102 to the first dielectric board 101. However, it is convenient if it is possible to fasten it temporarily in the erect position on the first dielectric board 101 before soldering it. Thus, in this embodiment, protrusions 102*c*, 102*d* are formed on the bottom of both end parts of the second dielectric board 102, as shown in FIG. 8(D). These can be inserted rather roughly into holes 101*a*, 101*b* provided for them on the first dielectric board 101. The holes also serve to position the second dielectric board in its prescribed position. However, these are designing matters, and any method may be adopted in order to hold the second dielectric board temporarily in the erect position.

When assembled in this manner, the lead lines 103, 104 are connected ohmically to both ends of the coupling element 110, while the lead lines 105, 106 also are connected ohmically to both ends of the coupling element 111. Thus, the construction is such that the two coupling elements 110, 111 face each other, separated by a dielectric material between their chief surfaces. On the rear surface of the first dielectric board 101, a conductive surface 113 attached to the circuit reference potential (generally the grounding potential) is formed in the manner generally seen in this type of directional couplers. The conductive surface may be formed over the entire rear surface of the first dielectric board, or at least in those parts of it which are directly below the vicinity of this directional coupler 100.

Thus, in the embodiment illustrated in FIGS. 8(A-)-(D), there are the coupling line part or coupling elements 110, 111 which face each other in plane-symmetrical fashion, separated by a dielectric board 102. Their coupling action can be explained in the following manner.

First of all, it is known that the following conditions must be realized in order to realize a wideband directional coupler:

$$\beta_o=\beta_e \quad (1)$$

$$Z_o=Z\cdot[(1-c)/(1=c)]^{0.5} \quad (2)$$

$$_e=Z\cdot[(1+c)/(1-c)]^{0.5} \quad (3)$$

Here, $\beta_o$ is the phase constant and $Z_o$ is the impedance when, of the two orthogonal modes, the odd mode is excited, and $\beta_e$ and $Z_e$ are the phase constant and impedance when the even mode is excited. Z is the characteristic impedance of the terminal and c is the degree of coupling of the circuit.

That is, Equations (2) and (3) above mean that the following equation is necessary:

$$Z_3>Z_o \quad (4)$$

Figure 9A:
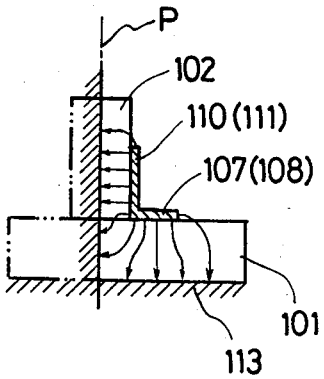
FIGS. 9(A), 9(B), 10(A) and 10(B) are explanatory drawings of the operations of that embodiment.

Consequently, let us first consider the electric field in the directional coupler 100 in the embodiment in FIGS. 8(A)-(D). When the odd mode is excited, the imaginary plane P assuring planar symmetry between the coupling elements 110 and 111 becomes an electrical wall, as is shown in FIG. 9(A), and the lines of electric force are distributed so that most of them pass through the first and second dielectric boards 101, 102. Thus, the circuit has a capacity $C_o$ per unit length.

Figure 9B:
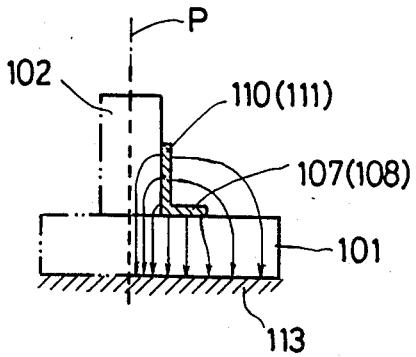

On the other hand, when the even mode is excited, the imaginary plane (symmetrical plane) P at the center of thickness of the second dielectric board 102 becomes a magnetic wall, as is shown in FIG. 9(B), and the lines of electric force are distributed so that some of them also pass through the surrounding medium. At this time also, the circuit has a specific capacity $C_e$ per unit length.

Consequently, if the dielectric constant of the second dielectic board 102 is chosen so as to be larger than that of the surrounding medium by a sufficient difference, it will be possible to satisfy relatively easily the condition expressed by:

$$C_o > C_e \quad (5)$$

Figure 10A:
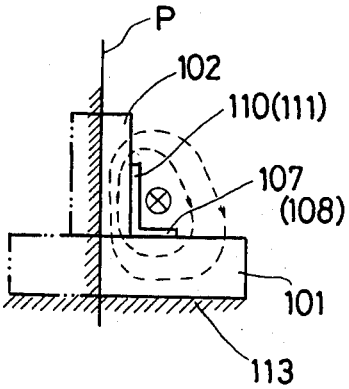

Concerning the magnetic field, when the odd mode is excited, since the imaginary plane (symmetrical plane) P is an electical wall, there is a loop-shaped distribution such as that shown by the arrows in FIG. 10(A), and the circuit at this time has a specific inductance $L_o$ per unit length.

Figure 10B:
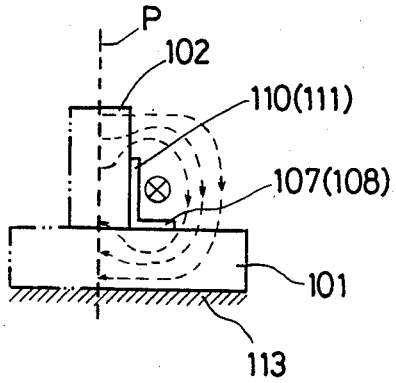

On the other hand, when the even mode is excited, the lines of magnetic force clearly have a distribution such as that shown in FIG. 10(B). At this time also, the circuit has a specific inductance $L_e$ per unit length.

Consequently, a distribution of lines of magnetic force such as that shown in the figure means that the mutual inductance between the circuit 110 (107) and the circuit 111 (108) becomes negative when the odd mode is excited and, on the other hand, that it becomes positive when the even mode is excited. This indicates, therefore, that:

$$L_o < L_e \quad (6)$$

As is clear from Equations (5) and (6), as long as the dielectric constant and plate thickness of the second dielectric board 102 used, the circuit dimensions concerning coupling elements 110 and 111, and the circuit dimensions concerning the distribution line parts 107 and 108 are designed appropriately, the following can be satisfied easily:

$$(L_o \cdot C_o)^{0.5} = (L_e \cdot C_e)^{0.5} \quad (7)$$

$$(L_o/C_o)^{0.5} < (L_e/C_e)^{0.5} \quad (8)$$

Equation (7) can satisfy the phase conditions given in Equation (1), and Equation (8) can satisfy the impedance conditions given in Equation (2). Consequently, by using this invention it is possible to obtain a wide-band directional coupler, and it is also possible, by suitably designing $Z_o$ and $Z_e$, to adopt freely any component designs with a broad range of permissible degrees of coupling. Naturally, the distribution line parts 107 and 108 will even become unnecessary in some cases.

A particular advantage that can be attained by this invention is the fact that the material of the second dielectric board 102, a second design condition, can be chosen freely, even though it may be necessary (and in most cases this probably will be necessary) for the first dielectric board 101 to be made of the material specified for the printed-wiring boards bearing the other peripheral circuit systems (for example, it may be necessary for the first dielectric board 101 to be made of paper phenol).

For example, in cases where a high efficiency is required, it is possible to select expensive materials such as Teflon for the second dielectric board. Even in this case, the directional coupler can be manufactured inexpensively, while still attaining a higher performance, since the dimensions of the second dielectric board 102 are not very large as compared with the past configuration in which it would have been necessary to use such expensive boards in all of the other boards on which the surrounding circuit systems were mounted, and the use of expensive materials can be held down to the minimum necessary limit.

The manufacturing method for obtaining such excellent effects is also extremely simple, does not require special skills, and can be realized merely by assembling the boards and soldering them together. Moreover, the two-dimensional space occupied can be reduced greatly, making it possible to respond to the need for attain super-miniaturization of various electronic devices.

Figure 11A:
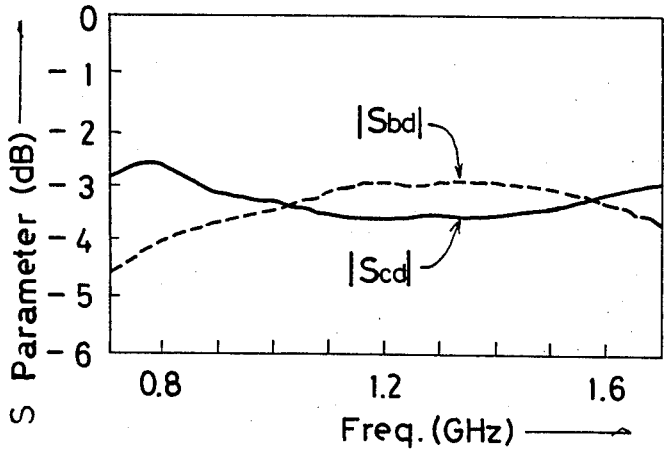
FIGS. 11(A) and 11(B) are graphs plotting the characteristics of directional couplers actually fabricated on the basis of FIG. 8(A)-(D).

Test results concerning the performance of directional couplers having the configuration described above are explained below in accordance with FIG. 11(A) and (B). We shall first divulge the data concerning a −3 dB directional coupler in the 1 GHz band prepared on the basis of this invention. The following are the dimensions of its parts and its parameters such as the dielectric constant and dielectric loss tangent:

| | |
|---|---|
| Thickness of first dielectric board 101: | 1.6 mm |
| Thickness of copper foil for its conductors: | 104 μm |
| Dielectric constant at 1 GHz: | 3.65 |
| Dielectric loss tangent at 1 GHz: | 0.0045 |
| Thickness of second dielectric board 102: | 0.7 mm |
| Thickness of copper foil for its conductors: | 104 μm |
| Dielectric constant at 1 GHz: | 3.65 |
| Dielectric loss tangent at 1 GHz: | 0.0045 |

The following are the dimensions of its parts:

| | |
|---|---|
| Width of coupling elements 110, 111: | 3.7 mm |
| Length of above coupling elements: | 37.3 mm |
| Width of distribution line parts 107, 108: | 1.3 mm |
| Length of above line parts: | 37.3 mm |
| Width of lead line parts 103–106: | 3.45 mm |
| Length of above line parts: | 100.0 mm |

Figure 11B:
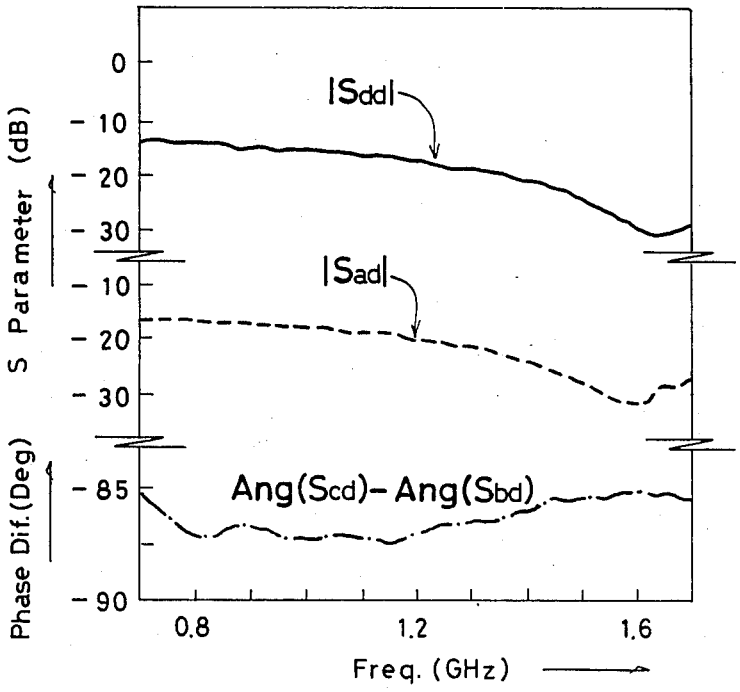

The S parameters displayed characteristics such as those shown in FIGS. 11 (A) and (B). The attributes a–d used here are terminal designations assigned in sequence to lead lines 103–106 in FIG. 8(B).

As is clear from these characteristic curves, good results amounting to a difference of a degree of coupling of 0.6 dB or less, a phase deviation of 3 degrees or less, a directivity of 18 dB or higher, and an input/output return loss of 15 dB or more, were obtained within the range of 0.86–1.60 GHz (a fractional bandwidth 57.8%). On the whole, good characteristics were obtained in these tests approximately across the octave band, although an insertion loss of about 0.3 dB occurred on account of the dielectric loss.

The same materials were used in both the first and second dielectric boards in the above tests. However, it is clear from the parameter characteristics that it would naturally be possible to obtain even better characteristics, for example by making the second dielectric board of a material from which better characteristics can be expected.

In the first embodiment described above, the coupling line elements 110 and 111 were formed on plane-symmetrical surface parallel to an imaginary plane P which is vertical to the first dielectric board 101. However, as mentioned above, it is not necessary for the coupling line elements always to be vertical with respect to the first dielectric board 101.

Figure 12:
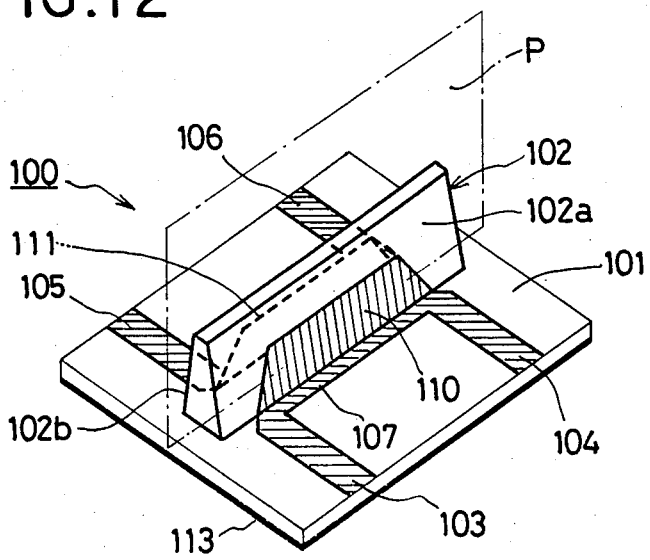
FIGS. 12 through 17 are each schematic drawings of the configurations of other embodiments of this invention.
Figure 13:
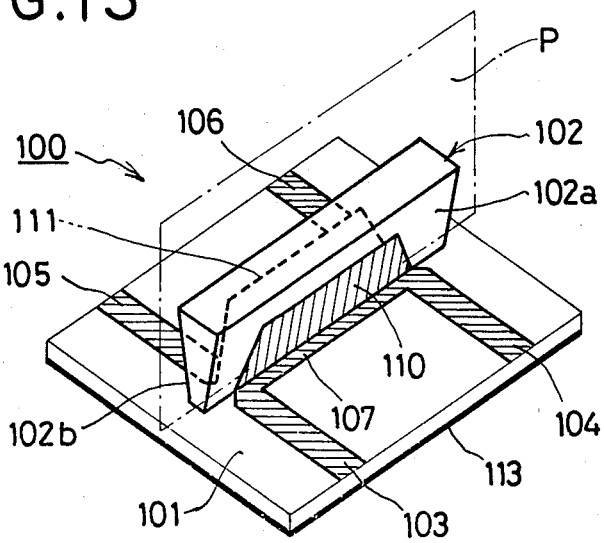

For example, surfaces 102*a* and 102*b* of the second dielectric board 102, which includes an imaginary plane P which is vertical with respect to the first dielectric board 101, may be inclined in a reverse V-shape so as to form a trapezoid shape, as in the second embodiment, shown in FIG. 12. Otherwise, surfaces 102*a* and 102*b* may be inclined in a V-shape so as to form reverse trapezoidal shape, as shown in FIG. 13. In these cases also, both surfaces 102*a* and 102*b* of the second dielectric board 102 maintain their plane symmetry towards the imaginary plane P which is vertical with respect to the first dielectric board 101.

In these embodiments and in those cited below, structural elements which have been assigned the same symbols as those in the first embodiment are identical with or equivalent to them.

Figure 14:
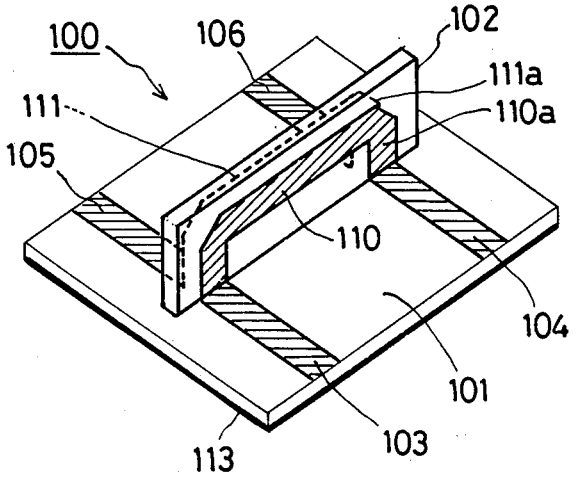

It is also permissible to adopt a configuration in which the distribution lines 107 and 108 are miniaturized or are made unnecessary. Naturally, the corresponding parts 107 and 108 may be omitted also in the group of embodiments cited above. Furthermore, as is shown in FIG. 14, it is permissible to pattern the coupling elements 110 and 111 of the coupling line part higher than the surfaces of the second dielectric board 102, forming a part of the second dielectric board which extends in the elevation direction, as in the partial coupling elements 110*a* (111*a*). This can be done in order to reduce the size further while still retaining the effective length of the coupling elements 110, 111.

Figure 15:
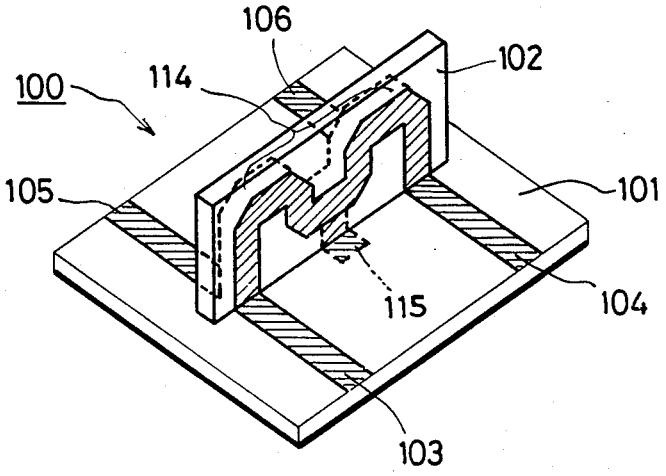

Moreover, the effective length can also be extended by giving a meandering construction to the parts 114 of the coupling elements 110, 111, as in the coupler 100 shown in FIG. 15. In addition, if the capacity or inductance caused by the presence of the distribution line parts 107, 108 described above should become necessary in connection with the electrical characteristics, they may be mounted centrally by a conductor pattern in accordance with part 115, shown by the imaginary line.

Figure 16:
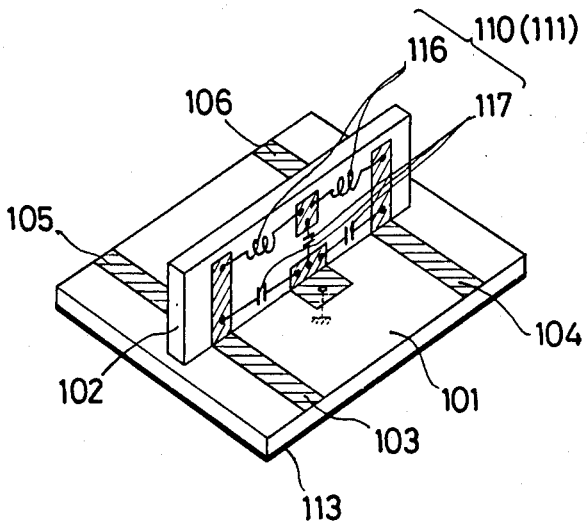

In addition, in the embodiments cited above, in each case the coupling elements 110, 111 are formed literally with the conductor lines alone, but they can be changed to the centrally mounted type. That is, as shown in FIG. 16, the inductance can be formed by coils 116, which may be wire coils or print coils, and capacitors 117 such as ceramic capacitors or print capacitors can similarly be substituted for the capacitance. In the same manner, the centrally mounted parts, such as the imaginary line part 115 in the configuration of FIG. 15 above, can be easily replaced by individual parts.

In each of the embodiments above, the coupling elements 110, 111 constituting the coupling line part were each formed on only one side of the second dielectric board 102. That is, the coupling line part was each made of a single element.

Figure 17:
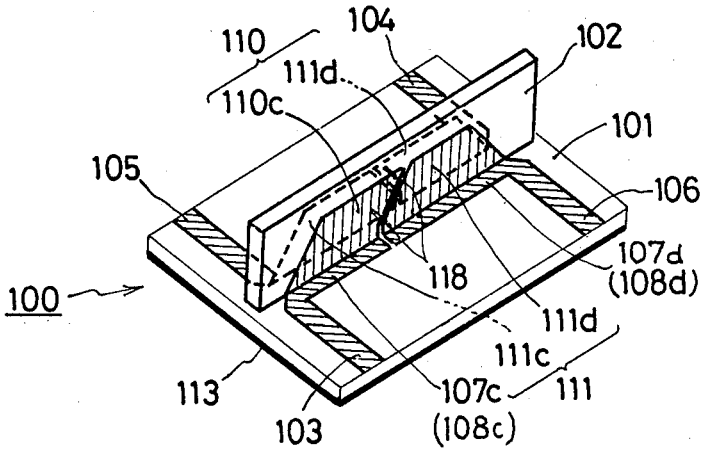

However, in cases where the connections with the peripheral circuits would be benefited, for example, by changing the relative positions or the lead-out directions of the four input/output terminals 103–106, as in the embodiment shown in FIG. 17, the coupling elements 110, 111 may be divided into two partial coupling elements, a first and a second (110*c*, 110*d*; 111*c*, 111*d*), and each of the pairs of coupling elements may be positioned individually on the opposite surfaces of the second dielectric board 102. Their ends close to the center may then be connected electrically by means of a through-hole penetrating through the second dielectric board 102 or by means of a connecting part having conduction means 118 such as a metal machine screw or a metal rod. In such cases, the distribution line parts 107, 108 installed corresponding to them may also, if necessary, be divided into two parts (107*c*, 107*d*; 108*c*, 108*d*).

Strictly speaking, in this embodiment, one can assume that the coupling line parts 110, 111 are composed of the partial coupling elements (110*c*, 110*d*; 111*c*, 111*d*), which face each other and perform functions connected with coupling, and the conduction means 118, which connects these elements facing each other. The partial coupling elements (110*c*, 110*d*; 111*c*, 111*d*) are the only parts which must be formed plane-symmetrically towards the imaginary surface which is vertical with respect to the first dielectic board 101, and the configuration of the connecting parts, including the conduction means 118 and the conductive pattern parts in its vicinity, it not subject to this limitation.

Furthermore, the embodiment given here can generally be expanded into a construction consisting of an integral number of partial coupling elements.

That is, let us suppose that coupling line parts 110, 111 consist of a collection of partial coupling elements of a number of n, from the 1st to the n'th. The partial coupling elements from the 1st to the n'th should then be installed so that they are alternately divided in the width direction of the second dielectric board 102 between one side and the other side of the second dielectric board, while arranging so that the adjacent ends of the adjacent partial coupling elements will be electrically connected to each other through a connection part which includes conduction means 118 penetrating through the second dielectric board 102. In addition, each of the partial coupling elements within the coupling line part should face towards the partial coupling element of the same number in the corresponding coupling line part, and they should be configured so that they will be arranged facing each other separated by the second dielectric board 102.

Consequently, if such a configuration is adopted, the number of connection parts in this case will naturally be n-1. If the number is n=2, this corresponding to the embodiments given above.

If this is adopted, for example when an even number has been chosen for n, in the embodiments up to FIG. 16, it is possible to change the relative positions of the four lead lines so as to be convenient for connecting them with the peripheral circuits. For example, one lead line 106 which was on the left side of the second dielectric board 102 may be arranged on the right side of the second dielectric board 102; or on the contrary, one lead line 104 which was on the right side may be arranged on the left side.

If an odd number has been chosen for n, changing the relative positions of the lead lines has no effect as a result. However, it is entirely conceivable that individual coupling elements might be configured from groups of such partial elements on account of design requirements or for the sake of intentionally adjusting the characteristics. In this case, the configuration ought to be selected in accordance with such requirements. That is, a number of 2 or more should be selected as the value of n, but it does not matter whether the number is odd or even.

It is not necessary for all of the partial coupling elements to have exactly the same dimensions. For example, even if there are two of them, one may be larger than the other.

This philosophy can be developed further, and a configuration in which the partial coupling elements on one side or at the farthest ends are miniaturized to the ultimate limit so that the connection parts can be positioned on the end sides of the second dielectric board can also come within the range of this invention.

A number of embodiments have been described above. It is also possible to combine and modify a number of the characteristic component portions of these embodiments as necessary. The invention is to embrace without exception all technologies which are based on the basic philosophy of this invention as described above.

What is claimed is:

1. A microwave directional coupler comprising: a first dielectric board;

a second dielectric board erected on the first dielectic board;

coupling line part which consists of at least one pair of coupling elements facing each other separated by the second dielectric board, said at least one pair of coupling elements being formed by patterning, said at least one pair of coupling elements having patterns which are symmetric with respect to said second dielectric board, and lead lines which are connected to both ends of each of the pair of coupling line parts and which are formed on the first dielectric board;

the coupling elements of the coupling line part being formed one on either surface of the second dielectric board above the first dielectric board and conductor parts extending in the elevation direction of the second dielectric board being formed to connect the coupling elements with the respective lead lines on the first dielectric board.

2. A microwave directional coupler comprising: a first dielectric board;

a second dielectric board erected on the first dielectric board;

coupling line part which consists of at least one pair of coupling elements facing each other separated by the second dielectric board, said at least one pair of coupling elements being formed by patterning, said at least one pair of coupling elements having patterns which are symmetric with respect to said second dielectric board, and lead lines which are connected to both ends of each of the pair of coupling line parts and which are formed on the first dielectric board;

the coupling elements of the coupling line part being arranged in inclined form on both surfaces of the second dielectric board.

3. A microwave directional coupler comprising: a first dielectric board;

a second dielectric board erected on the first dielectric board;

coupling line part which consists of at least one pair of coupling elements facing each other separated by the second dielectric board, said at least one pair of coupling elements being formed by patterning, said at least one pair of coupling elements having patterns which are symmetric with respect to said second dielectric board, and lead lines which are connected to both ends of each of the pair of coupling line parts and which are formed on the first dielectric board;

positioning protrusions being formed on the bottom edges of both ends of the second dielectric board, and positioning holes for receiving the positioning protrusions of the second dielectric board being formed in the first dielectric board.

4. A microwave directional coupler comprising: a first dielectric board;

a second dielectric board erected on the first dielectric board;

coupling line part which consists of at least one pair of coupling elements facing each other separated by the second dielectric board, said at least one pair of coupling elements being formed by patterning, said at least one pair of coupling elements having patterns which are symmetric with respect to said second dielectric board, and lead lines which are connected to both ends of each of the pair of coupling line parts and which are formed on the first dielectric board;

the coupling elements having a meandering construction.

* * * * *